United States Patent [19]

Husher

[11] 4,445,977

[45] May 1, 1984

[54] COKE OVEN HAVING AN OFFSET EXPANSION JOINT AND METHOD OF INSTALLATION THEREOF

[75] Inventor: Lee K. Husher, Bethel Park, Pa.

[73] Assignee: Furnco Construction Corporation, Carnegie, Pa.

[21] Appl. No.: 470,610

[22] Filed: Feb. 28, 1983

[51] Int. Cl.[3] ..... C10B 29/02; C10B 29/04; C10B 29/06

[52] U.S. Cl. ..... 202/223; 201/18; 201/41; 202/267 R; 202/268

[58] Field of Search ..... 202/223, 267 R, 268, 202/269; 201/18, 41; 432/3, 76; 52/747

[56] References Cited

U.S. PATENT DOCUMENTS

| | | | |
|---|---|---|---|
| 1,040,093 | 10/1912 | Adkins, Jr. . | |
| 1,807,868 | 6/1931 | Nygaard . | |
| 2,023,174 | 12/1935 | Hofmann . | |
| 2,077,842 | 4/1937 | Kuhl et al. | 202/223 |
| 2,218,806 | 10/1940 | Betterton et al. . | |
| 2,361,205 | 10/1944 | Hoover | 72/106 |
| 2,476,305 | 7/1949 | Kimmel | 52/747 |
| 2,561,933 | 7/1951 | Longenecker . | |
| 2,853,440 | 9/1958 | Hughes | 202/268 |
| 3,167,883 | 2/1965 | Hofmann . | |
| 3,190,815 | 6/1965 | Wethly | 202/223 |
| 3,519,256 | 7/1970 | Heisterkamp . | |
| 3,940,244 | 2/1976 | Sauder et al. | 432/247 |
| 3,993,237 | 11/1976 | Sauder et al. | 228/140 |
| 4,059,885 | 11/1977 | Oldengott | 202/267 R |
| 4,075,812 | 2/1978 | Koyama et al. | 52/747 |
| 4,194,036 | 3/1980 | Davis et al. | 428/74 |
| 4,202,148 | 5/1980 | Frahme et al. | 52/592 |
| 4,259,159 | 3/1981 | Hohler | 202/269 |
| 4,344,753 | 8/1982 | Shelley et al. | 432/3 |

FOREIGN PATENT DOCUMENTS

| | | | |
|---|---|---|---|
| 2460906 | 7/1976 | Fed. Rep. of Germany | 202/268 |
| 1555459 | 11/1979 | United Kingdom . | |

*Primary Examiner*—Bradley Garris

*Attorney, Agent, or Firm*—Webb, Burden, Robinson & Webb

[57] ABSTRACT

An offset expansion joint and method of installing the same in a repaired or rebuilt furnace, such as a coke oven or the like, comprises at least two segments of ceramic fiber spaced laterally from one another and separated by silica bricks and a barrier of silica mortar which extends along an edge of each segment and along an edge of each of the bricks by which the segments are spaced, the silica mortar having the ability to set up when exposed to about 2200° F. to prevent passage of gas through the expansion joint in the area of the horizontal flue of the coke oven.

5 Claims, 11 Drawing Figures

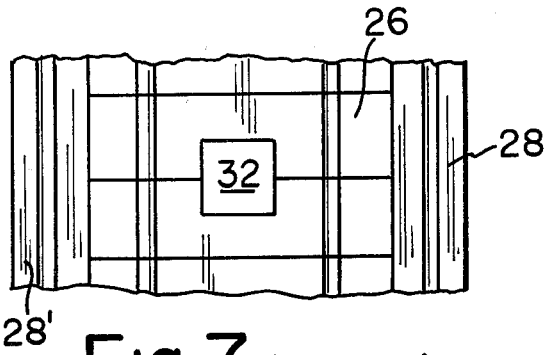
Fig. 7 (TIER 71)
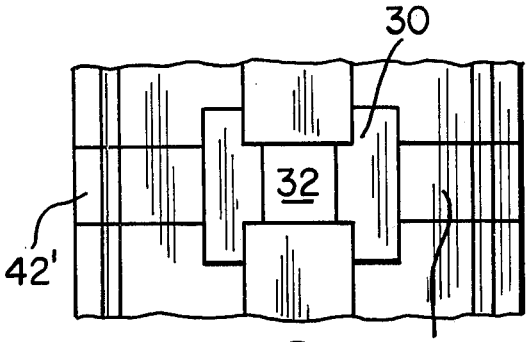
Fig. 8 (TIER 72)
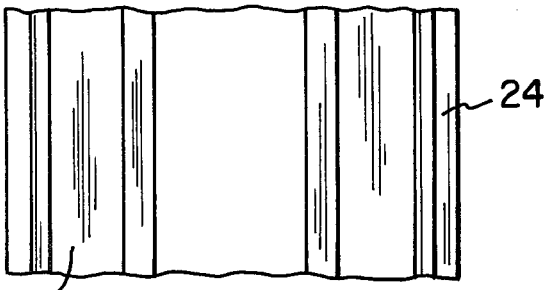
Fig. 6 (TIER 70)
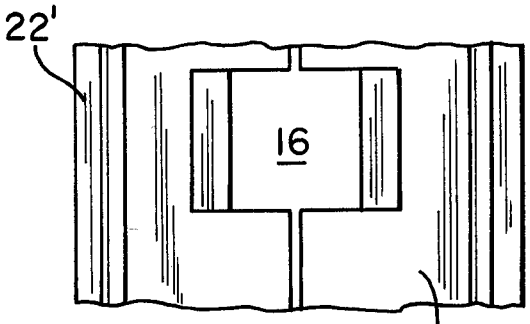
Fig. 5 (TIER 69)
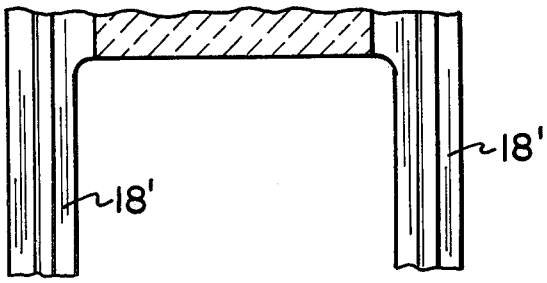
Fig. 3 (TIER 67)
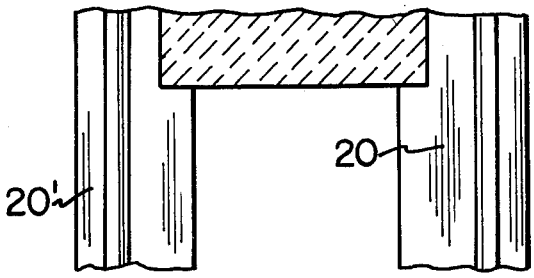
Fig. 4 (TIER 68)
PRIOR ART

COKE OVEN HAVING AN OFFSET EXPANSION JOINT AND METHOD OF INSTALLATION THEREOF

BACKGROUND OF THE INVENTION

1. Field of the Invention

This invention relates to expansion joints and particularly to expansion joints for coke ovens. More particularly, the invention concerns a new offset expansion joint for installation in the brickwork in the area of the horizontal flue during repair or rehabilitation of coke ovens, especially those designed by Koppers, Carl Still, Otto, Wilputte, Didier and Nippon Steel. The invention also relates to the method of installing the offset expansion joint.

2. Brief Description of the Prior Art

Until about 1970, most coke oven batteries in the United States were 4 meter batteries which were built for an expected life of about 20 years. In the 1970's the industry began to install batteries which were greater than 5 meters, and usually were 6 meters, which have about an 8–10 year life span based upon industry experience, at which time they must be repaired or rehabilitated.

It was expected that the techniques previously used to repair prior 4 meter batteries, namely rebuilding of the oven walls using various types of compressible material disposed in horizontal cross-section in the brickwork, could be applied to the 6 meter batteries. However, these techniques have not been completely successful.

As is well known, it is important to prohibit the leakage of raw coke oven gas from the oven chambers through the oven brickwork into the flue chambers. Such flue gas leakage is generally attributed to excessive spacing or gaps between bricks. The main reason for flue gas leakage occurs at the interface between old brickwork and new brickwork.

Leakage of coke oven gas into the flues may result in ignition, causing temperatures in excess of oven design which would destroy the silica brick. In addition, if the gases do not ignite totally within the flue system, but are evacuated to atmosphere through the waste heat stack, such gases may result in violation of government standards, such as the Environmental Protection Act, which may require the installation of expensive electrostatic precipitators in the waste heat system.

Due to the unpredictability of the expansion of the old brick and the new brick used in rebuilding the larger size coke ovens, the compressible materials installed using prior techniques are insufficient to prevent leakage of the coke oven gases. In the past, expansion joints of various materials, such as wood, spun silica, compressible mortar or the like have been used between bricks in adjacent tiers of a coke oven, but never in an offset relationship. It has now been recognized by the inventor that a new type expansion joint was needed to compensate for the unpredictable expansion of new brick when heated.

SUMMARY OF THE INVENTION

The present invention comprises an offset expansion joint for use in the brickwork of ovens, and particularly in the repair of coke oven walls between the old brick and the new brick. The expansion joint is constructed of a plurality of segments of ceramic fiber, preferably in the form of mats, placed in offset relationship to the existing silica brickwork and separated by a silica mortar which acts as a slip joint in the arrangement. The preferred ceramic fiber is spun silica and functions as a compressible refractory in the brickwork.

The improved expansion joint is useful in a brickwork construction of the vertical flue in the area of the horizontal flue chamber of a coke oven, the top of which is formed by a first tier of brick wherein the brickwork is subject to unpredictable expansion upon an increase in temperature. The expansion joint comprises a brick in a second tier of brickwork below and spaced from said first tier brick and forming an inner wall of the flue chamber and an outer wall of a coke oven chamber. A first segment of ceramic fiber is positioned on said second tier brick and within the space between the first tier brick and the second tier brick. The inner edge of the first segment is generally aligned with the inner edge of the second tier brick and the outer edge of the segment is generally aligned with the outer edge of the first tier brick which forms the top of the flue chamber. An outer brick in the first tier of brickwork has an outer edge in alignment with and forms a portion of the wall of the coke oven chamber and has an inner edge in abutment with the outer edge of the first segment and the outer edge of the first tier brick which forms the top of the flue chamber in the first tier. A second segment of ceramic fiber is positioned on the outer brick in the first tier, the inner edge of the second segment being in abutment with the outer edge of the first tier brick and the outer edge of the second segment being aligned with and forming a portion of the wall of the coke oven chamber. A brick in a third tier above the first tier brick is positioned on the first tier brick and the second segment, the outer edge of the third tier brick forming a portion of the coke oven wall. The first and second segments are offset from one another laterally and a common barrier composed of silica mortar extends along the outer edge of the first segment, the inner edge of the second segment, the outer edge of the first tier brick and the inner edge of the outer brick in the first tier to form a slip joint. The mortar is characterized by its ability, upon exposure to a temperature of about 2200° F. for a sufficient time, to set up to prevent leakage of gas through the brickwork in the area of the expansion joint for the horizontal flue. Preferably, each of the segments comprises a batt of ceramic fiber, and more preferably a batt of spun silica. An expansion joint according to the invention is preferably located in the horizontal flue area on each side of the horizontal flue chamber.

The method of installing the offset expansion joint in accordance with the invention comprises, in the construction of the vertical flue brickwork in a coke oven in the area of the horizontal flue chamber to prevent leakage of gas from the oven chamber into the horizontal flue chamber through the bricks of an existing or new tier of refractory brick, supporting a first tier of brick of inner and outer brick which defines the top of the horizontal flue chamber from the roof of the coke oven. A second tier of brick is built up on both sides of the flue to an elevation adjacent and below the first tier. By alternately supporting the outer bricks of the first tier on each side of the flue, a first segment of ceramic fiber is placed on the second tier brick and adjacent the first tier brick. The inner edge of the first segment is generally aligned with the inner edge of the flue and the outer edge of the segment is generally aligned with the outer edge of the first tier brick. Generally the bottom and top edges of the second tier brick are coated with mortar. According to the invention, the exposed edge of the first segment and the first tier brick are also coated with a silica mortar to provide a barrier forming a slip joint. When the support is removed, the outer brick is positioned on the second tier brick in such a way that one edge of the outer brick is in abutment with the silica mortar barrier formed by the coated segment and the opposite edge of the outer brick is in alignment with the outer edge of the second tier brick forming a portion of the coke oven wall. A second segment of ceramic fiber is disposed on the top surface of the outer brick such that one edge of the segment is in abutment with the barrier of the coated first tier brick and the opposite edge is in alignment with the edge of the outer brick and forms a portion of the wall of the coke oven. The segment fits between the top surface of the outer first tier brick and the bottom surface of an upper brick forming a portion of the coke oven wall. The method of installing the segments of the horizontal flue is carried out at the same time on opposite sides of the flue to provide expansion joints in the walls of adjacent coke oven chambers of a coke oven battery.

Since expansion of silica brick occurs at approximately 1400° F. and the silica mortar does not thermally set until a temperature of approximately 2200° F. is reached, expansion of the brick takes place as the oven wall is heating up, compressing the ceramic fiber with the brick therebetween and slipping along the mortar joint barrier. When a temperature of approximately 2200° F. is reached, the silica mortar sets up causing a compression of the joint and creating a gas tight impermeable barrier through the brickwork from the oven chamber to the flue chambers of the coke oven.

The offset expansion joint of the present invention is applicable to all known coke ovens, including those of Koppers, Carl Still, Otto, Wilputte, Didier and Nippon Steel. The invention is useful in any coke oven flue design including those of the single divided, double divided, hairpin, and Koppers-Becker type.

BRIEF DESCRIPTION OF THE DRAWINGS

In the Figures:

FIG. 3 is a partial plan view of tier 67;

FIG. 4 is a partial plan view of tier 68;

FIG. 5 is a partial plan view of tier 69;

FIG. 6 is a partial plan view of tier 70;

FIG. 7 is a partial plan view of tier 71;

FIG. 8 is a partial plan view of tier 72;

FIGS. 1–8 represent the prior art.

DESCRIPTION OF A PRESENTLY PREFERRED EMBODIMENT OF THE INVENTION

Figure 1:
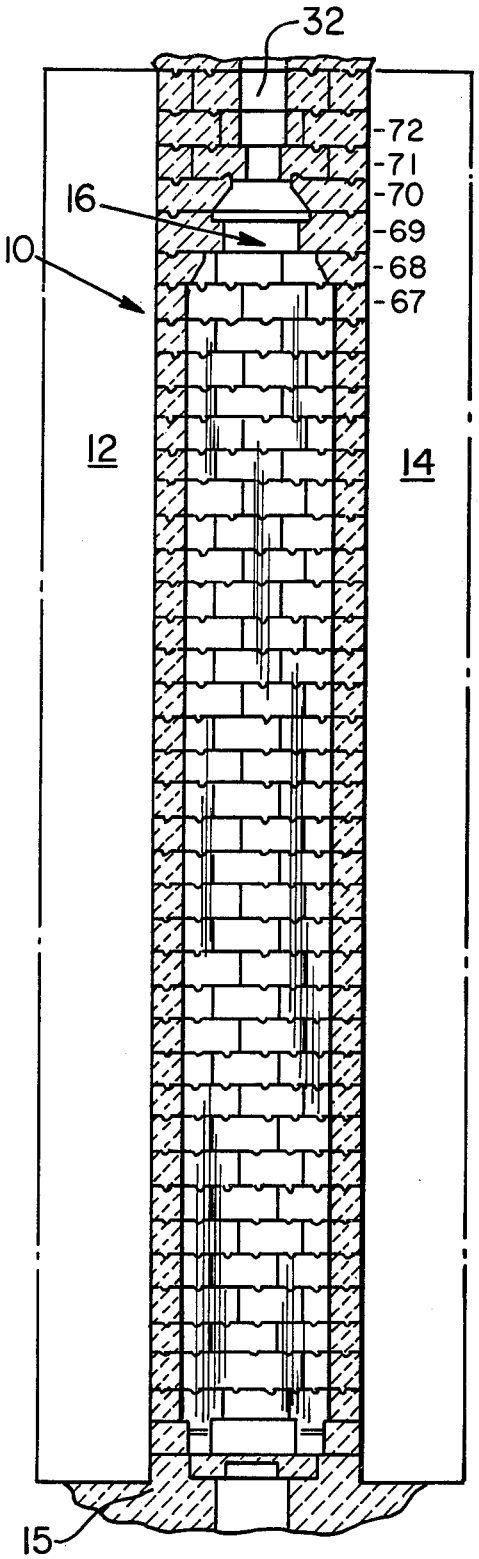
Fig. 1 PRIOR ART
FIG. 1 is a sectional view taken along a vertical plane through the centerline of a vertical flue in a Koppers design coke oven.
Figure 2:
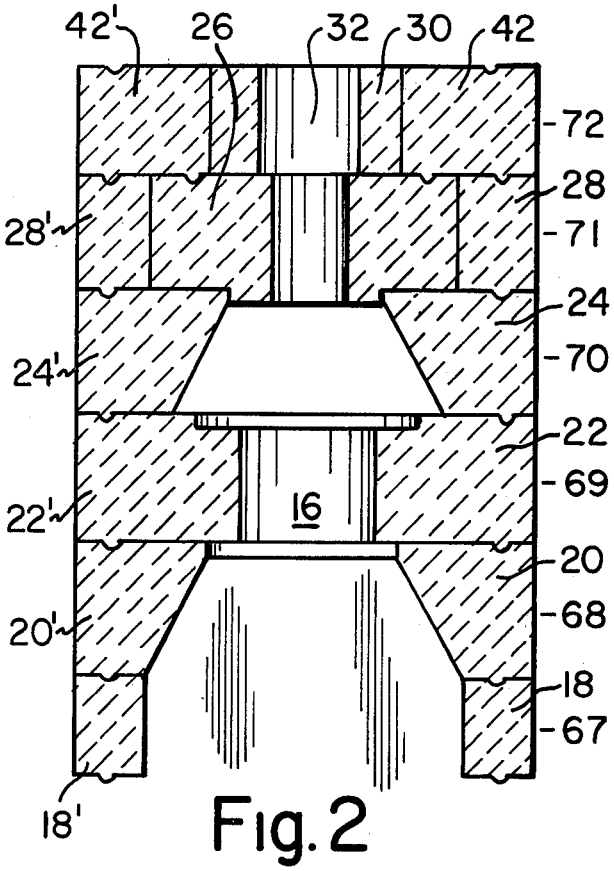
Fig. 2 PRIOR ART
FIG. 2 is an enlarged sectional view of the brickwork in the horizontal flue area at tiers 67–72 of the flue of FIG. 1.

Referring to FIG. 1, a portion of a vertical flue 10 between two ovens 12, 14 of a typical Koopers design illustrates the conventional brickwork pattern in a coke oven battery. A plurality of tiers of brickwork is provided above the coke oven floor portion 15 of the battery forming the vertical flue. A plurality of vertical flues connect into a horizontal flue 16 at about tier 69 identified on FIG. 1. The horizontal flue runs through tiers 67–70 and permits passage of gas from one set of vertical flues to another in the battery in the conventional manner according to the design of the oven. As is well known, the direction of gas flow is reversible from time to time.

FIGS. 2–8 show, in enlargement, the conventional configuration of the bricks in tiers 67–72 of the vertical flue of FIG. 1 prior to the installation of the offset expansion joint according to the present invention. Referring particularly to those figures, the brickwork adjacent the horizontal flue 16 comprises a plurality of tiers of interlocking refractory bricks. One side of the horizontal flue is defined by bricks 18, 20, 22 and 24. The top of the horizontal flue is formed by bricks 26, 28, 30 and 42. For convenience, the brickwork forming the opposite side of the horizontal flue is the same except of opposite hand and is indicated by the same reference numerals with a prime (') added. Bricks 26 and 30 have a center opening 32 for visual inspection.

Figure 9A:
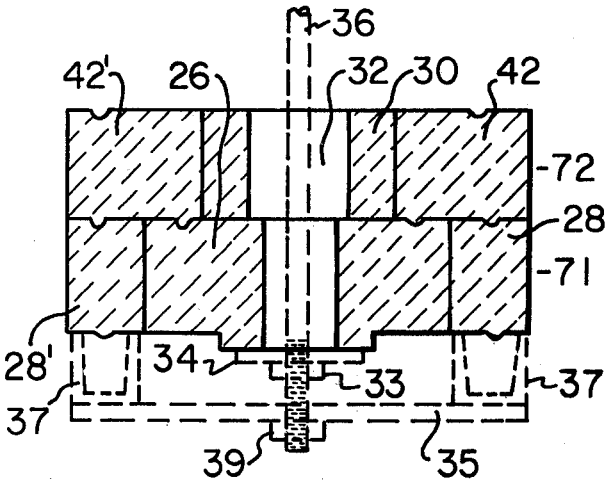
FIG. 9A is an enlarged sectional view of a portion of the brickwork above the horizontal flue showing the support for the brickwork during installation of the offset expansion joint in accordance with the invention.
Figure 9B:
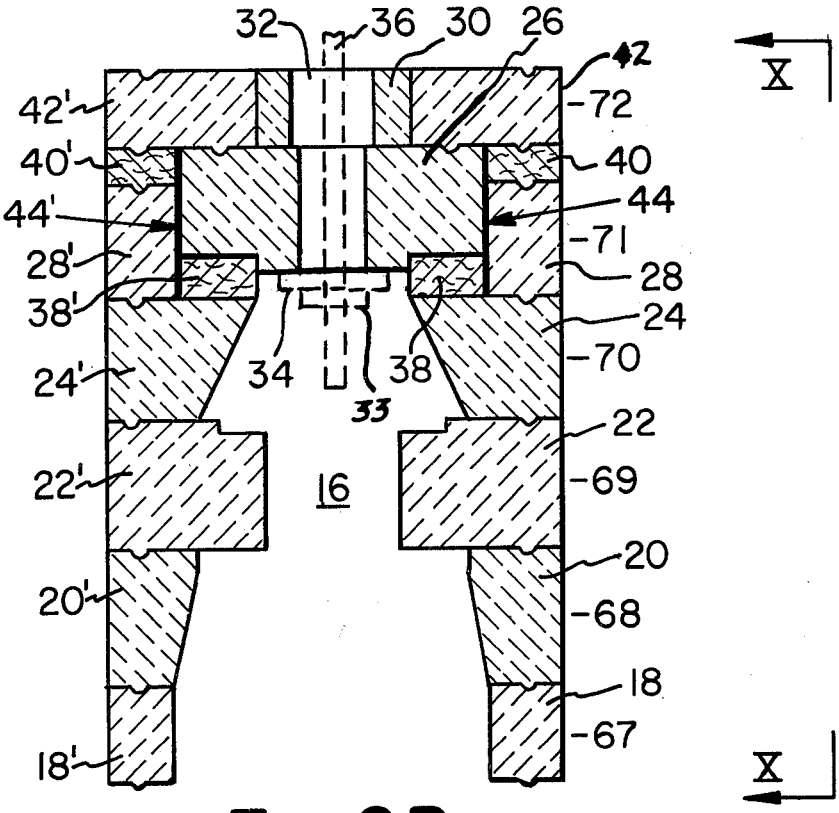
FIG. 9B is an enlarged sectional view of the brickwork in the horizontal flue area at tiers 67–72 of the oven and including the offset expansion joint in accordance with the invention.
Figure 10:
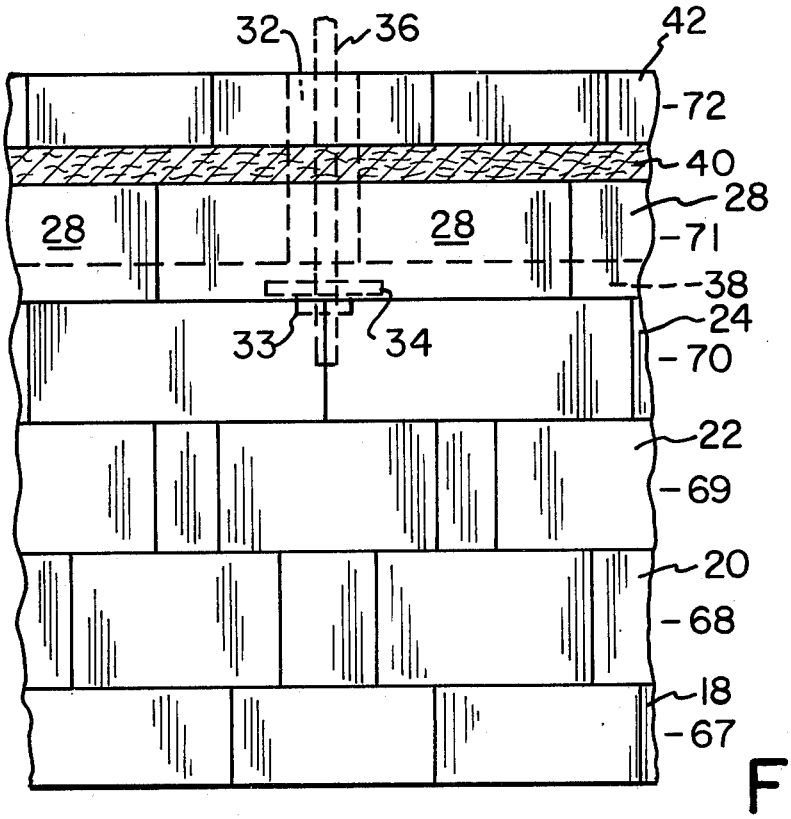
FIG. 10 is a partial elevational view taken along lines X—X of FIG. 9B.

The expansion joint according to the invention is an overlap expansion joint as shown in FIGS. 9B and 10. The refractory bricks 20, 20'; 22, 22'; and 24, 24' surround the horizontal flue, as shown in FIGS. 1–8. They also form a portion of the walls of the oven chambers 12, 14, respectively.

The offset expansion joint is installed by a novel method which involves supporting the brickwork above the horizontal flue 16. A preferred means of support uses a plate 34 depending from a suspension means, such as a threaded rod 36, extending through the inspection flue 32 and supported at the roof of the oven (not shown). The plate is retained by a nut 33 threaded to rod 36. An additional plate 35 having a pair of channels 37 is secured to rod 36 by nut 39 to support outer bricks 28, 28' as shown in FIG. 9A. By supporting the brickwork above the horizontal flue 16, it is possible to remove all brickwork therebelow to floor level 15 including the brickwork adjacent and forming the walls of the horizontal flue and ovens to install the expansion joint utilizing ceramic fiber segments 38, 40 and 38', 40' in offset relationship, respectively. The segments are preferably in the form of spun silica mats and are compressible.

As shown in FIGS. 9B and 10, for example, segment 38 is placed between tiers 70 and 71; segment 40 is placed between tiers 71 and 72. The tier numbers given are, of course, only representative and the only criterion is that the segments be placed in tiers in the area of the horizontal flue between the new brick being built up from the coke oven floor 15 of the oven battery and the old brick which is being supported from the roof of the battery. To install the offset expansion joint according to the method of the invention, it being understood that the brick 26 and the bricks above it in the flue are being supported by the suspension means with plates 34 and 35 with channels 37, the bricks are built from the floor level portion to the level of tier 70, for example, with the bricks being mortared as in conventional practice.

When the bricks 22, 22' of tier 69, for example, are in place, it is desirable to continue the work on both sides of the horizontal flue area at the same time. On one side, according to this method, the bricks 28' are wedged longitudinally by wooden wedges or the like (not shown) while brick 24 is placed on the opposite side.

A first mat or segment 38 of ceramic fiber, such as spun silica, is installed in the space, which has been previously calculated, between the top of the brick 24 and the bottom of the brick 26 with the outer edge of segment 38 being vertically aligned with the outer edge of the brick 26. The exposed outer edges of the brick and the segment are thoroughly coated with a silica mortar. Next, brick 28 is then mortared conventionally, plate 35 with channels 37 is removed and brick 28 is interlocked to brick 24, the outer edge of brick 28 forming a portion of the wall of oven 14. A second mat or segment 40 of ceramic material, such as spun silica, is placed in offset relationship to the first segment 38 and separated therefrom by brick 26 as shown. Tier 72 of brick 42 is supported on the segment 40 and brick 26 and adjacent brick 30. The common silica mortar joint or barrier 44 extends along the edges of segments 38 and 40 abutted between brick 24 and brick 26 and bricks 28 and 42, respectively. The barrier 44 acts as a slip joint for the expansion joint. Since the mortar does not set up until a temperature of approximately 2200° F. is reached, the bricks are free to expand and the spun silica segments are compressed to prevent passage of gas from within the oven 14 to the flue. When a temperature of approximately 1400° F. is reached, and expansion is essentially complete, the continued application of heat to the joints results in the solidification of the silica mortar and the elimination of any air passage through the brickwork between bricks 24, 26, 28 and 42. The same procedure is followed on the opposite side of the flue. Segment 38' is placed, brick 28' which was previously wedged longitudinally, is dropped into place and segment 40' is placed between bricks 28' and 42'. Of course, as the bricks and segments are placed, they are coated with a silica mortar and a barrier 44' of silica mortar which acts as a slip joint is formed along the outer edge of segment 38', the outer edge of brick 26, the inner edge of brick 28' and the inner edge of segment 40'.

The present invention is especially suitable for use at the interface between old and new silica brick, such as when walls in coke ovens are repaired and rebuilt. The invention provides a straightforward, relatively inexpensive solution to the problem of how to effectively accommodate expansion in brickwork whose expansion rates are unpredictable, as well as to substantially eliminate passage of gas through the brickwork at the interface. The invention is applicable to all known coke oven batteries, notwithstanding that they are individually unique.

Having described presently preferred embodiments of the invention, it may be otherwise embodied within the scope of the appended claims.

I claim:

1. In a coke oven having brickwork in the horizontal flue area of a horizontal flue chamber which is subject to thermal expansion wherein the bricks forming the brickwork are arranged in tiers and the top of the flue chamber is defined by a fixed tier of brick at a fixed elevation relative to the roof of the oven, the improvement in an expansion joint for preventing the leakage of gas from the oven chamber into the flue chamber comprising:

A. brick in a lower tier of brickwork below and spaced from said fixed tier brick and forming an inner wall of the flue chamber and an outer wall of a coke oven chamber;

B. a first segment of ceramic fiber positioned on said lower tier brick and within the space between the fixed tier brick and the lower tier brick, the inner edge of said segment being generally aligned with the inner edge of the lower tier brick and the outer edge of said segment being generally aligned with the outer edge of said fixed tier brick forming the top of the flue chamber;

C. an outer brick in said fixed tier having an outer edge in alignment with and forming a portion of the wall of the coke oven chamber and having an inner edge in abutment with the outer edge of said first segment and the outer edge of said fixed tier brick forming the top of the flue chamber in said fixed tier;

D. a second segment of ceramic fiber positioned on said outer brick in said fixed tier, the inner edge of said second segment in abutment with the outer edge of said fixed tier brick and the outer edge of said second segment being aligned with and forming a portion of the wall of the coke oven chamber;

E. brick in an upper tier above said fixed tier brick positioned on said fixed tier brick and said second segment, the outer edge of said upper tier brick forming a portion of the coke oven wall;

F. said first and second segments being offset from one another laterally and a common barrier composed of silica mortar extending along the outer edge of said first segment, the inner edge of said second segment, the outer edge of said fixed tier brick and the inner edge of said outer brick in said fixed tier to form a slip joint and said mortar being characterized by its ability, upon exposure to a temperature of about 2200° F. for sufficient time, to set up to prevent leakage of gas through said brickwork in the area of said expansion joint.

2. In a coke oven as set forth in claim 1, each of said segments comprises a batt of ceramic fiber.

3. In a coke oven as set forth in claim 1, said expansion joint being located in the horizontal flue area on each side of the horizontal flue chamber.

4. A method of constructing brickwork having an expansion joint in a coke oven in the area of the horizontal flue chamber to prevent leakage of gas from the oven chamber into the horizontal flue chamber through the bricks of an existing or new tier of refractory brick comprising:

A. supporting a fixed tier of brickwork defining the top of the flue chamber from the roof of the oven at a fixed elevation with respect thereto;

B. building a lower tier of brick up to an elevation adjacent and below said fixed tier;

C. disposing a first segment of ceramic fiber on said lower tier brick and adjacent said fixed tier brick such that an inner edge of said segment is generally aligned with the inner edge of said lower tier brick and the outer edge of said segment is generally aligned with the outer edge of said fixed tier brick;

D. coating the outer edges of said segment and said fixed tier brick with a silica mortar to provide a barrier forming a slip joint;

E. placing an outer brick on said lower tier brick such that one edge of said outer brick is in abutment with the coated edges of said segment and said fixed tier brick and the opposite edge of said outer brick is in alignment with the outer edge of said lower tier brick forming a portion of the coke oven wall; and F. disposing a second segment of ceramic fiber on said outer brick such that one edge of said segment is in abutment with the coated edges of said fixed tier brick and the opposite edge is in alignment with the outer edge of said outer brick and forming a portion of the wall of said coke oven, and beneath a further brick in an upper tier, the outer edge of said further brick forming a portion of the coke oven wall.

5. The method as set forth in claim 4 wherein each of the steps A through F is carried out on both sides of the horizontal flue chamber substantially simultaneously to complete expansion joints in adjacent coke oven chamber walls of a coke oven battery.

* * * * *